United States Patent [19]

Zettek

[11] Patent Number: 4,630,935

[45] Date of Patent: Dec. 23, 1986

[54] OTHER TIME INSTRUMENT

[76] Inventor: Charles M. Zettek, 39 E. Main St., Hopkinton, Mass. 01748

[21] Appl. No.: 646,777

[22] Filed: Sep. 4, 1984

[51] Int. Cl.[4] ..... G04B 45/00

[52] U.S. Cl. ..... 368/41; 368/28; 368/70

[58] Field of Search ..... 368/41–44, 368/45, 28, 69, 70, 71

[56] References Cited

U.S. PATENT DOCUMENTS

| | | | |
|---|---|---|---|
| 3,691,757 | 9/1972 | Merino et al. | 368/45 |
| 4,293,845 | 10/1981 | Villa-Real | 340/309.3 |
| 4,490,711 | 12/1984 | Johnston | 368/43 |

*Primary Examiner*—Bernard Roskoski

*Attorney, Agent, or Firm*—John E. Toupal; Harold G. Jarcho

[57] ABSTRACT

An electronic timepiece including a clock for providing an output indicative of natural time, a clock display for displaying time of day information provided by the clock, a chronograph for counting given elapsed natural time periods and a chronograph display for displaying the total such periods counted by the chronograph. The timeplace further includes a manually operable actuator, a calculator for counting sequential actuations of the actuator, and an other time display for displaying the accumulated total of sequential actuations counted by the calculator. Additionally provided in the timepiece are a manual chronograph reset for setting to zero the counted total of elapsed natural time periods and a manual other time reset for setting to zero the counted sequential actuations of the actuator.

15 Claims, 3 Drawing Figures

OTHER TIME INSTRUMENT

BACKGROUND OF THE INVENTION

It has long been accepted that at least two types of time coexist in the physical world as perceived and explained or described by members of the human race. Natural time, or sidereal time, is recognized and recorded on the device we call a chronometer, the common watch or clock. It is well known also that a unique phenomenon or quality of the human mind is that the mind can, with the mental activity we call thought, speed up or slow down the process of nature. A simple example is the way human thought can traverse thousands of years or billions of miles in a moment by thinking of a past event or of a distant star. Such thoughts are transported to a past historical event faster then the speed of light, not to change that past event but to learn something from it. This time that takes place in human thought, that is, the time that takes place within the individual human mind is what we call human time. This human time is selectively interchangeable with natural time depending on the individual. During the time that a human flashback thought is in process, for example, natural time moves relentlessly forward at its own natural rate, irrespective of human thought, as measured in minutes, days, or years. To put it simply, there is no flexibility to natural time which can only move in the one direction we humans perceive to be forward and irreversible. Individual human thought, however, can and does move forward and backward relative thereto. Thus, although the two types of time coexist, they do so in a different way and at different speeds at a rate unique to each individual person. Consequently, the correlation between natural time and human time for any individual is not easily perceived. Prior to the present invention no convenient timing device has existed for recording both natural time and human time on a single visual display. The object of this invention, therefore, is to provide a device that records for any individual person his or her human time in combination with natural or chronological time.

SUMMARY OF THE INVENTION

The invention is an electronic timepiece including a clock for providing an output indicative of natural time, a clock display for displaying time of day information provided by the clock, a chronograph for counting given elapsed natural time periods and a chronograph display for displaying the total such periods counted by the chronograph. The timepiece further includes a manually operable actuator, a calculator for counting sequential actuations of the actuator, and an "other time" display for displaying the accumulated total of sequential actuations counted by the calculator. Additionally provided in the timepiece are a manual chrongraph reset for setting to zero the counted total of elapsed natural time periods and a manual other time reset for setting to zero the counted sequential actuations of the actuator. Appropriate use of the timepiece provides an observable record of an individual's achievements toward a predetermined goal or objective with respect to the passage of natural time.

According to one feature of the invention, the chronograph display and the other time display are distinct, simultaneously observable displays and the chronograph continuously counts 24 hour periods for accumulated total periods of greater than 31 days. This feature allows the individual user to readily monitor his predetermined goal achievements for natural time periods of in excess of one month.

According to another feature of the invention, the timepiece includes a plurality of independently operable actuators, the calculator counts the sequential actuations of each actuator and the "other time" display includes a plurality of distinct "other time" displays each displaying the accumulated total of sequential actuations of a different one of the actuators. This feature permits the individual user to continuously monitor his achievements with respect to a plurality of predetermined goals or objectives.

According to yet another feature of the invention, the timepiece includes a start-up date display that is controlled by the chronograph and the chronograph reset. The start-up date display provides the user with a visual indication of the date on which the predetermined goals were established.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
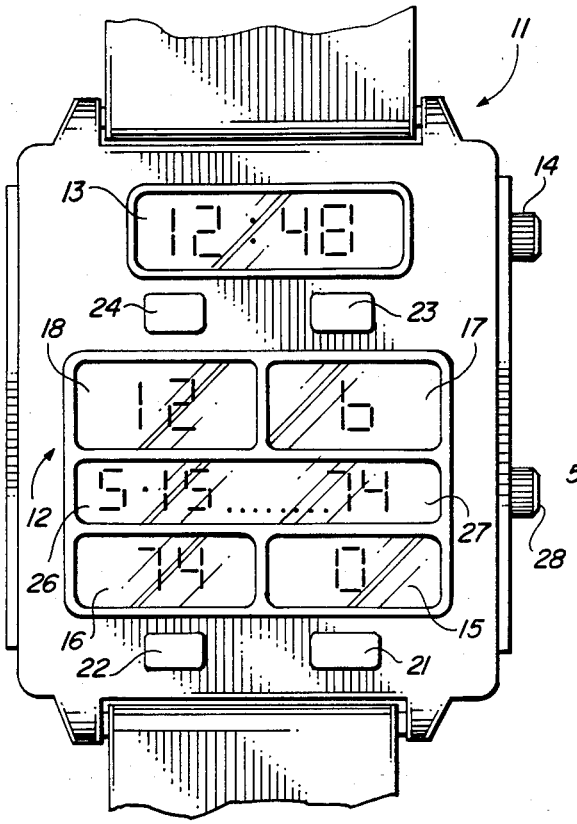
FIG. 1 is a schematic front view of a timepiece according to the invention.

The invention is shown in a preferred form as a watch 11 in FIG. 1. A front face 12 of the watch 11 includes a conventional time of day display 13 for indicating present sidereal time in hours and minutes. In response to actuation of a switch button 14 the display 13 can alternatively function to indicate the current month and day. The button 14 additionally can be used to correctly set the display 13. Also included in the front face 12 of the watch 11 are a first other time display 15, a second other time display 16, a third other time display 17 and a fourth other time display 18. Controlling the information presented by the displays 15–18, respectively, are a first counter switch button 21, a second counter switch button 22, a third counter switch button 23 and a fourth counter switch button 24. Additional displays on the face 12 of the watch 11 are a start-up date display 26 and a total days display 27. A reset switch button 28 is provided for resetting the other time displays 15–18, the start-up date display 26 and the total days display 27 all of which are of any conventional type such as liquid crystal devices.

Figure 2:
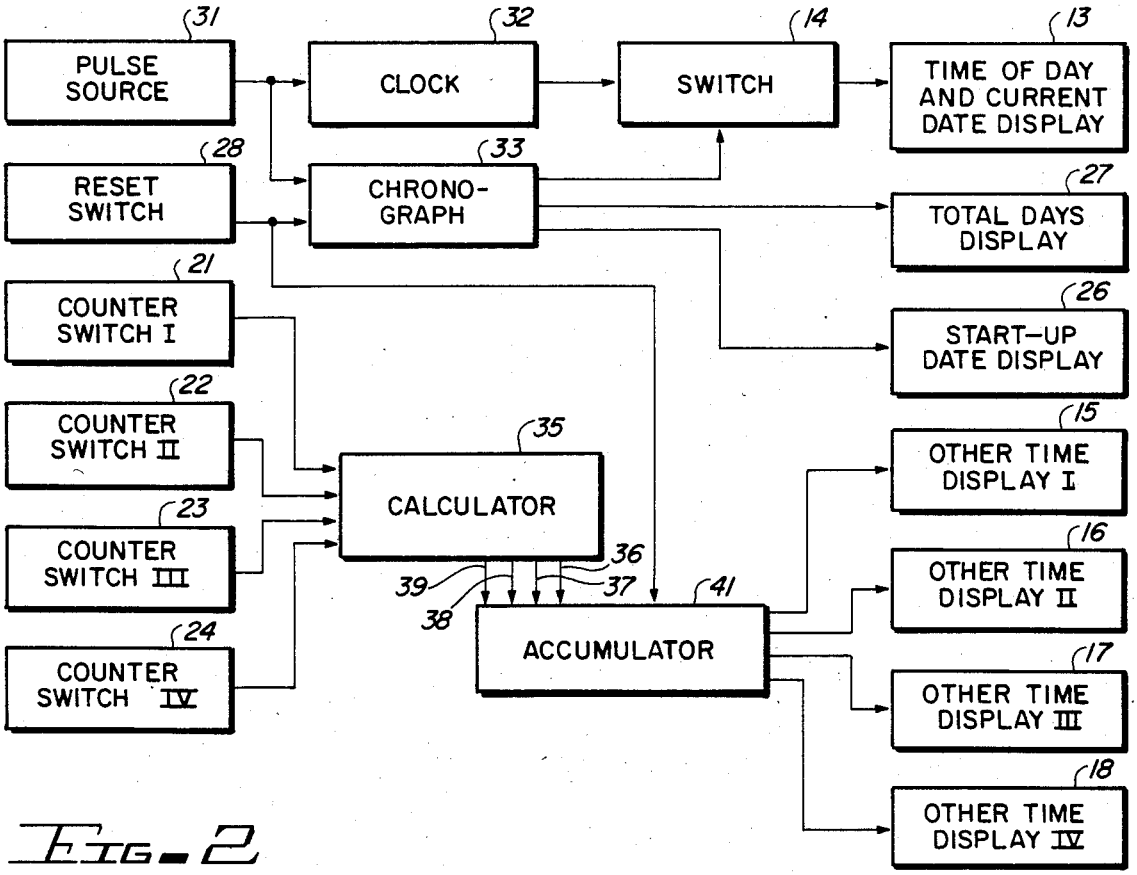
FIG. 2 is a schematic block diagram of an electronic control circuit for the timepiece shown in FIG. 1.

Control of the watch 11 is provided by conventional, well known electronic circuit components that are shown in block diagram form in FIG. 2. A pulse source 31 feeds pulses to both a clock 32 and a chronograph 33, the latter of which is coupled also to the reset switch 28. The information retained by the clock 32 and the chronograph 33, respectively, are alternatively fed to the time of day or current date display 13 under control of the switch 14. In addition, the chronograph 33 provides information to the start-up date display 26 and the total days display 27. An electronic calculator 35 receives inputs from the counter switches 21–24 and provides outputs 36–39 to an information accumulator 41 that is coupled also to the reset switch 28. The information retained in the memory of the accumulator 41 is provided for display to the other time displays 15–18.

OPERATION OF THE PREFERRED EMBODIMENT

The clock 32 and the chronograph 33 function in a conventional manner to provide alternatively either present natural time in hours and minutes or the current natural time date as a month and day to the display 13. In addition, the chronograph 33 provides the start-up display 26 and the total days display 27, respectively, with the date on which the reset switch 28 was last actuated and the total number of 24 hour sidereal days that have elapsed since that date. The calculator 35 counts the manual sequential actuations of the counter switches 21–24 and provides outputs 36–39 representing the accumulated total of such actuations for each switch. Storing the outputs 36–39 is the accumulator 41 which feeds that information to the other time displays 15–18. Actuation of the reset switch 28 clears the memories of the chronograph 33 and the accumulator 41 thereby resetting to zero the totals presented by the total days display and the other time displays 15–18 and establishing a current date in the start-up date display 26.

When operated in a preferred manner, the timepiece 11 records for visual observation and thereby influences the unique personal experiences of an individual user. Those experiences fall into two basic areas; i.e. internal experiences and external experiences. In turn, internal experiences can be subdivided into experiences of the conscious self which are displayed in the other time display 15, and experiences of the subconscious or intuitive self which are displayed in the other time display 16. Similarly, external experiences can be subdivided into those involving day to day human contacts; typically family, friends, neighbors and immediate associates which are displayed in the other time display 17, and more distant human influences which are displayed in other time display 18. Thus, a user can set personal goals or objectives in each of the four areas of personal experience and record achievements toward those goals by appropriate actuation of the counter switches 21–24. The user's progress toward his predetermined goals can be continuously monitored on the other time displays 15–18 and compared to elapsed natural time presented by the start-up date display 26 and the total days display 27.

By way of example, one might set a conscious experience goal of reading from some specific material source for a certain minimum time period during each day. Each time that objective is accomplished, the counter switch 21 would be actuated, that actuation would be counted in the calculator 35 and the total number of such sequential actuations would be displayed by the other time display 15. Similarly, in another example, a user might set a subconscious experience goal of promptly documenting the details of specific dreams. Again, each accomplishment of that objective would be accompanied by an actuation of the counter switch 22 with the total sequential actuations thereof counted by the calculator 35 and displayed by the other time display 16. An example of a day to day external experience goal might be to communicate more frequently either verbally or in writing with a particular family member. Each satisfaction of that predetermined objective would be accompanied by actuation of the counter switch 23 and the total number of such actuations would be counted by the calculator 35 and displayed by the other time display 17. Finally, a typical distant external experience goal might be to attend meetings of a community service group. Again, each satisfaction of that objective would be accompanied by an actuation of the counter switch 24 and the total number of such actuations would be counted by the calculator 35 and displayed by the other time display 18. Comparison of the totals displayed by the other time displays 15–18 with elapsed natural time days displayed by the total days display 27 would provide the individual user with a continuous indication of his relative success in achieving the stipulated goals which would have meaning to only the user. A new goal sequence could be established by actuation of the reset switch 28 to clear the memories in the chronograph 33 and the accumulator 41 and thereby reset to zero the totals shown by the other time displays 15–18, and the total days display 27 while setting the current date in the start-up date display 26.

The timepiece 11 of FIG. 1, therefore, illustrates the following hypothetical set of circumstances. The time of day display 13 indicates a present natural time of 12:48 either a.m. or p.m. A predetermined set of goals was established and the reset switch 28 activated on May 15th as indicated by the start-up date display 26 and 74 natural days have since elapsed as shown by the total days display 27. The other time display 16 indicates that in regard to predetermined goals for exploring the subconscious, 74 objectives have been achieved. Conversely, the zero in the other time display 15 indicates that no self development objectives have been achieved. The other time display 17 shows that 6 objectives have been accomplished with respect to goals set for contacts with family, friends or neighbors. Finally, the other time display 18 indicates that 12 objectives have been achieved during the 74 day periods for goals set with regard to contacts with other people. Thus, the user of the timepiece 11 is provided with a dynamic visual record of his internal and external experience goal achievements as they relate to elapsed natural time.

ANOTHER EMBODIMENT OF THE INVENTION

Figure 3:
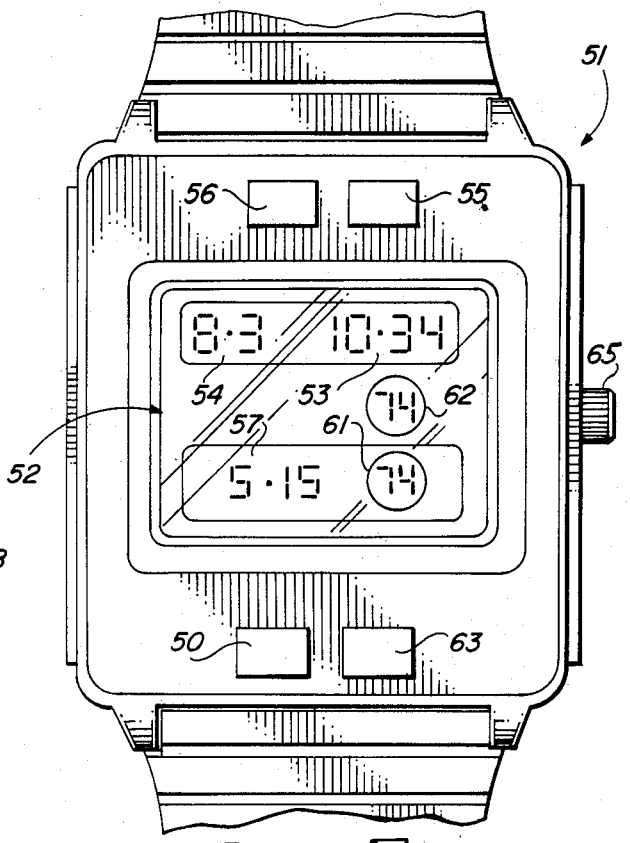
FIG. 3 is a schematic front view of another timepiece embodiment of the invention.

Illustrated in FIG. 3 is a somewhat simplified embodiment of the invention encompassing a watch 51 with a face 52. Included in the face 52 is a time of day display 53 that indicates the present natural time in hours and minutes and a current date display 54 that indicates the current natural time date in months and days. The information presented in the displays 53 and 54, respectively, can be set in a conventional manner by set buttons 55 and 56. A start-up date display 57 indicates the month and day on which a goal objective was initiated by actuation of a reset button 50. Indicated by a total days display 61 are the total number of days that have elapsed since the initiation of the goal objective. The total shown by the display 61 can be reset to zero with a reset button 63. Finally, an other time display 62 indicates the total number of actuations of a counter switch button 65.

The preferred use of the timepiece embodiment 51 is similar to that of the timepiece embodiment 11 shown in FIG. 1. However, in this case, the simplified timepiece 51 permits monitoring of only a single goal rather than the four distinct goals accommodated by the embodiment 11. Thus, the face 52 of the timepiece 51 indicates in displays 53 and 54, respectively, a present natural time of 10:34 either a.m. or p.m. on August 3rd. Indicated by the start-up date display 57 and the total days display 61, respectively, are that a predetermined goal objective was established on May 15th and that 74 days have since elapsed. Finally, the other time display 62 shows that 74 predetermined objectives have been achieved during the 74 day period.

Obviously, many modifications and variations of the present invention are possible in light of the above teachings. It is to be understood, therefore, that the invention can be practiced otherwise than as specifically described.

What is claimed is:

1. An electronic timepiece comprising:

clock means providing an output indicative of sidereal time;

clock display means for displaying time of day information provided by said clock means;

a chronograph means for automatically counting given elapsed sidereal time periods of greater than one hour and for accumulated totals of said periods greater than thirty one;

chronograph display means for continuously displaying the dynamic total of said periods counted by said chronograph means;

manually operable actuator means;

calculator means for counting sequential actuations of said actuator means;

other time display means for displaying the accumulated total of said sequential actuations counted by said calculator means;

manual chronograph reset means for setting to zero the counted total of said time periods; and other time reset means for setting to zero the counted sequential actuations of said actuator means.

2. A timepiece according to claim 1 wherein said chronograph display means and said other time display means are distinct simultaneously observable displays.

3. A timepiece according to claim 2 wherein said time periods are twenty four hour periods.

4. A timepiece according to claim 3 wherein said manually operated actuator means comprises a plurality of independently operable actuators, said calculator counts the sequential actuations of each said actuator, and said other time display means comprises a plurality of distinct other time displays each displaying the accumulated total of sequential actuations of a different one of said actuators.

5. A timepiece according to claim 4 wherein said reset means and said actuators comprises manually operable switches.

6. A timepiece according to claim 5 wherein said clock display is an independent display observable simultaneously with said chronograph and said other time displays.

7. An electronic timepiece comprising:

clock means providing an output indicative of sidereal time;

clock display means for displaying time of day information provided by said clock means;

a chronograph means for counting given elapsed sidereal time periods;

chronograph display means for displaying the total of said periods counted by said chronograph means;

manually operable actuator means;

calculator means for counting sequential actuations of said actuator means;

other time display means for displaying the accumulated total of said sequential actuations counted by said calculator means;

manual chronograph reset means for setting to zero the counted total of said time periods;

other time reset means for setting to zero the counted sequential actuations of said actuator means; and a start-up date display responsive to said chronograph and said chronograph reset means and continuously displaying for periods of greater than twenty four hours the date on which said chronograph reset means was last actuated.

8. A timepiece according to claim 7 wherein said time periods are twenty four hour periods and said chronograph means continuously measures said periods for accumulated total periods of greater than thirty one days.

9. A timepiece according to claim 8 wherein said reset means and said actuators comprises manually operable switches.

10. A timepiece according to claim 9 wherein said clock display is an independent display observable simultaneously with said chronograph and said other time displays.

11. A timepiece according to claim 7 wherein said reset means and said actuators comprises manually operable switches.

12. A timepiece according to claim 11 wherein said clock display is an independent display observable simultaneously with said chronograph and said other time displays.

13. A timepiece according to claim 7 wherein said chronograph display means and said other time display means are distinct simultaneously observable displays.

14. A timepiece according to claim 13 wherein said manually operated actuator means comprises a plurality of independently operable actuators, said calculator counts the sequential actuations of each said actuator, and said other time display means comprises a plurality of distinct other time displays each displaying the accumulated total of sequential actuations of a different one of said actuators.

15. A timepiece according to claim 14 wherein said time periods are twenty four hour periods and said chronograph means continuously measures said periods for accumulated total periods of greater than thirty one days.

* * * * *